US005873259A

United States Patent [19]

Spillman

[11] Patent Number: 5,873,259

[45] Date of Patent: Feb. 23, 1999

[54] SYSTEM FOR COOLING HEAD OF FLUID DISPENSING APPARATUS

[75] Inventor: Robert A. Spillman, Sandy, Utah

[73] Assignee: Utah Milk Technologies, L.C., Delta, Utah

[21] Appl. No.: 911,502

[22] Filed: Aug. 14, 1997

[51] Int. Cl.[6] ..... B67D 5/62

[52] U.S. Cl. ..... 62/396; 62/390; 222/146.6; 222/129.1

[58] Field of Search ..... 62/389, 390, 396, 62/399; 222/146.6, 129.1

[56] References Cited

U.S. PATENT DOCUMENTS

| | | | |
|---|---|---|---|
| 1,969,643 | 8/1934 | Fuchs et al. | 62/389 |
| 2,159,729 | 5/1939 | Ribble | 62/389 |
| 2,485,610 | 10/1949 | Kromer | 62/390 |
| 2,788,649 | 4/1957 | Tunt | 62/390 |
| 3,209,952 | 10/1965 | Cornelius | 62/390 |
| 4,679,408 | 7/1987 | Nelson | 62/390 |
| 4,730,463 | 3/1988 | Stanfill | 62/399 |

FOREIGN PATENT DOCUMENTS

| | | | |
|---|---|---|---|
| 35446 | 3/1979 | Japan | 62/389 |

*Primary Examiner*—William Doerrler
*Attorney, Agent, or Firm*—K. S. Cornaby

[57] ABSTRACT

A beverage dispensing apparatus having a recirculating channel circulating refrigerant to and through a dispenser head to keep cooled product at a constant temperature at all times to the point of emergence from the dispenser.

5 Claims, 7 Drawing Sheets

SYSTEM FOR COOLING HEAD OF FLUID DISPENSING APPARATUS

BACKGROUND OF INVENTION

This invention relates to a fluid dispensing apparatus for cooled liquids.

This invention was brought about by the need to facilitate the dispensing of products that will require constant refrigeration and not facilitate rapid germ and/or bacteria growth, causing spoilage.

U.S. Pat. No. 4,986,449 to Valiyee, and U.S. Pat. No. 4,732,300 to Valiyee, are examples of early prior art dispensing devices, that do not, however, cool the liquid to be dispensed through the entire traverse of the dispensing device.

The primary intended use of this device is to dispense milk and milk products. But, it will also benefit the dispensing of all beverages, including carbonated beverages; because the colder the product, the better the carbonation will be, and the longer the carbonation will last.

SUMMARY OF THE INVENTION

Water to be used to mix with concentrated milk and/or other products, is first filtered through a filtration system to get the water as clean as possible. The water will then enter into a pre-chiller, where the water is chilled to a temperature of approximately 36–38 degrees Fahrenheit.

The chilled water is then mixed with a chilled concentrated product to a proper consistency. The resulting fluid product is ideally contained in a bag-in-box container that will allow proper dispensing of the product.

The bag-in-box container, when ready to be used, is placed in a cooler to chill the product. This will aid in guarding against the contamination of the product.

The chilled food product, either pre-mixed or with the water in a separate line, then leaves the cooler. Once outside the cooler, the lines are wrapped with another line that carries a food-safe refrigerant, such as glycol or water, all the way up to and through the dispensing head. These lines are then enclosed with an insulated material to prevent loss of the cold, and to retain the product at a constant predetermined temperature.

The dispenser is constructed so that the refrigerant circulates through it, and then returns to the main cooling unit to be re-charged. This allows for a constant cooling process, even when the fluid product itself is not being dispensed.

Once the fluid product reaches the dispensing head or valve, the coolant surrounds the product and comes in contact with the dispensing valve to keep the whole system chilled. In this manner, the chilled product passes through a hand-held unit, or a countertop dispenser, both of which use the same process to keep the product chilled.

When the valve is opened for dispensing, it allows the chilled product to flow and be dispensed at a pre-determined mix-ratio. Once the valve is closed, the product stops flowing, but the refrigerant will continue to re-circulate.

DETAILED DESCRIPTION OF THE PREFERRED EMBODIMENTS

Figure 1:
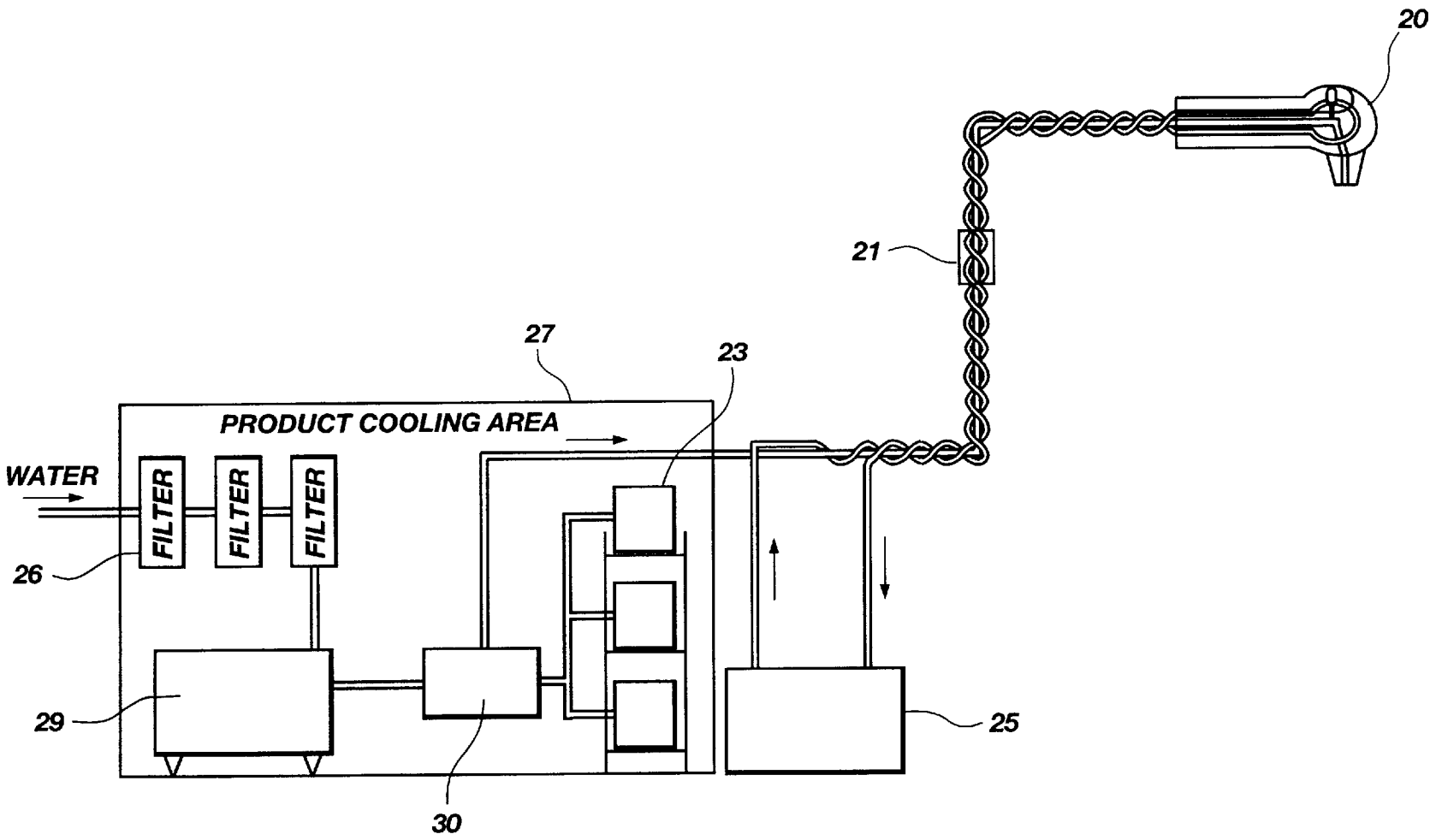
FIG. 1. A perspective view of a total refrigerated dispensing system.

As illustrated in the accompanying drawings, FIG. 1 shows an over-all perspective view of the cooling and dispensing apparatus of the invention. FIG. 1 includes the dispensing head, 20, which in this view is a solid hand-held device with channels running through it allowing the passage of water or glycol coolant throughout the dispensing head and returning to the product refrigeration area 27. Examples of base fluids include concentrated soft drink mixes, juices, drink bases and milk. Examples of mixing fluids are water and soda.

Figure 3:
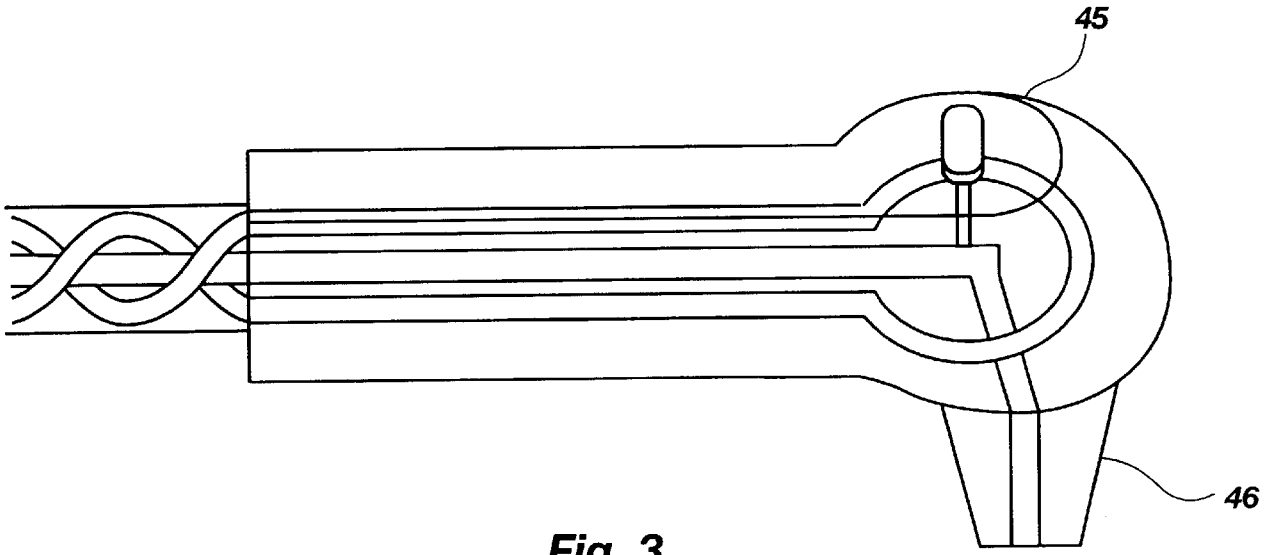
FIG. 3, illustrates the dispensing head with a detailed view of the dispensing valve, which when depressed allows the product to be dispensed.

Customarily, the mixing fluid is combined with the base fluid at the point of dispensing, as shown in FIG. 3. The base and mixing fluid and product coolant lines 21 typically are straight, while the coolant delivery line 21*b* is wrapped around the base and mixing fluid lines 21*a*, 21*d* from the time they leave the product refrigeration area 27 to where they enter the dispensing head 20.

The refrigerating or cooling product is supplied by a product chilling unit 25, located near the product refrigeration area 27. In this area, the coolant is recirculated to be recharged, which allows for a constant, predetermined temperature.

The base fluid is held in a bag-in-box container 23 that when ready to be used, is stored in a refrigerated container. The base fluids are drawn out of their containers 23 by a pumping mechanism 30 that pushes the base fluid to the point of dispensing head 20.

The mixing fluid (in this case, water) runs through a series of replaceable or rechargeable filters 26 and through a mixing fluid chiller 29 to be chilled down to dispensing temperature.

Figure 2:
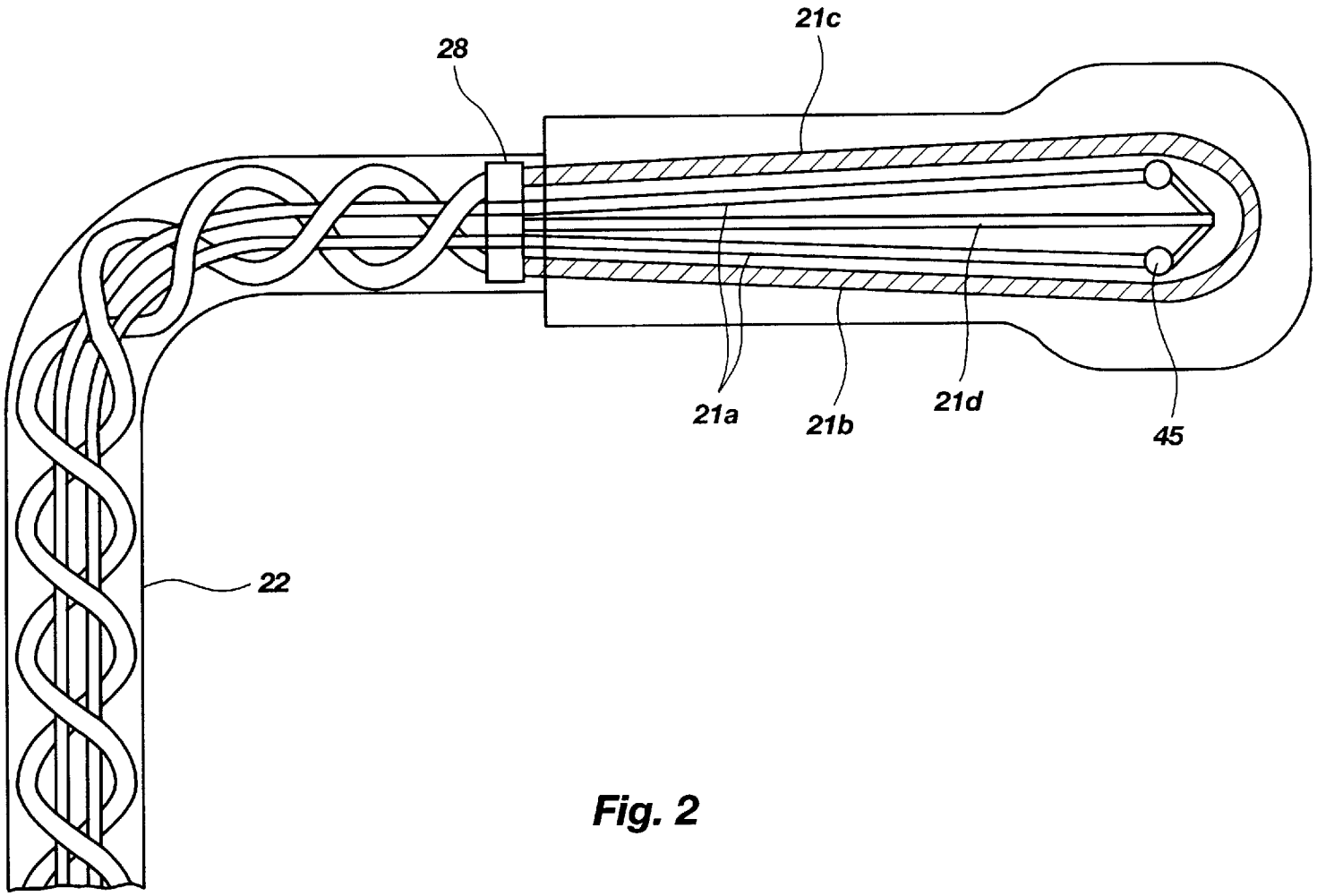
FIG. 2, shows the product line wrapped by the coolant line going through a sheath, and the track it follows through the dispensing head.

FIG. 2 is a close up view of the dispensing head 20. The base fluid line and channel 21*a* runs directly to the dispensing valve, from which it is dispensed.

The coolant delivery line 21*b* brings the cooling agent up and through the dispensing head 20, from which the coolant return line 21*c* returns the coolant to the chilling unit to be recharged and circulated repeatedly throughout the system, maintaining a cooling at all times. The mixing fluid line 21*d* runs with the base fluid line 21*a* and is also contained and wrapped by the coolant delivery and return lines 21*b* and 21*c*.

A flexible protective sheath 22 covers the base fluid line 21*a*, mixing fluid line, 21*d*, and the cooling delivery and return lines 21*b* and 21*c*. Sheath 22 extends from the dispenser head 20 to a base manifold, not shown, and usually runs in lengths of at least 30 inches and longer.

A dispensing activation switch 45, when depressed, opens the dispensing valve which allows the base fluid line 21*a* and mixing fluid line 21*d* to be dispensed in an amount pre-adjusted to give the proper mix ratio.

As shown in FIG. 2, item 28 is a water separating manifold. The recirculating cooling water is separated for three (3) different functions at this point. Most of the water will be diverted at this point to be returned for recharging. Part of the water flow will be diverted to flow through the dispensing head 20 to keep the base fluid line 21*a* chilled or cooled while in the dispensing head 20.

The third point of separation is activated when the dispensing activation switch 45 is engaged. Cold water from the coolant delivery line 21*b* will be diverted to be used as the mixing fluid coming from line 21*d*.

The water separating manifold 28 is used to ensure a proper flow of the cooling water. The flow of the cooling water from coolant delivery line 21*b* and coolant return line 21*c* may be greater than the flow through the dispensing head 20.

The water separating manifold 28 can allow the use of the cooling water from the coolant delivery line 21*b* as a source for the mixing fluid line 21*d*, utilizing less material and space needed for the cooling and mixing fluid lines 21*b* and 21*d*.

Figure 4:
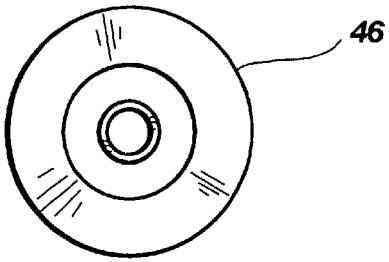
FIG. 4, is a view of mixing cone, from bottom to top.

In FIGS. 3 and 4, a detailed view of a diagram head shows a dispensing activation switch 45 and a mixing cone 46 which facilitates the mixing of the base fluid and mixing fluid.

Figure 5:
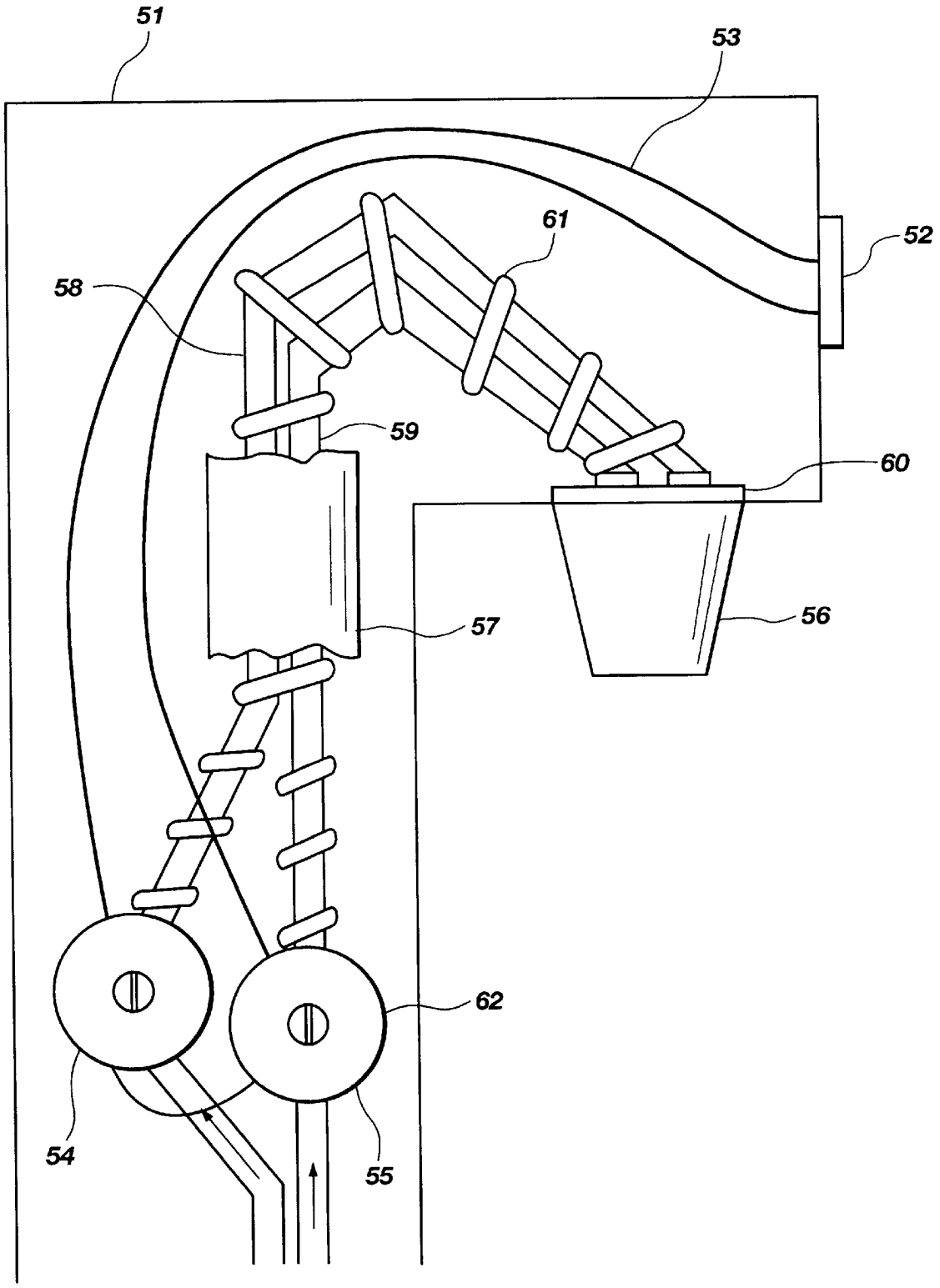
FIG. 5, a side elevational view, of the upper part of a countertop dispenser.

FIG. 5 shows a side elevational view of the top of a countertop dispensing unit 51. Activating the dispensing activation switch 52 opens the mixing and base fluid solenoid valves 54 and 55 which permits the product to start flowing at a predetermined rate to the dispensing head to be dispensed. When the dispensing activation switch 52 is released, the product flow is discontinued. The electrical wires 53 extend from the dispensing activation switch 52 to the mixing fluid solenoid valve 54 and the base fluid solenoid valve 55. A mixing cone 56 is employed to mix the product and mixing fluids together.

Insulating material 57 wraps the base and mixing lines from the cooling area to the point of dispensing. The mixing fluid line 58 and the base fluid line 59 extend from the solenoids to the dispensing head 60. The product mix ratio is determined by using the solenoid adjusting screws 62 that either decrease or increase the flow of either the base or mixing fluids, depending on the required mix ratio.

Figure 6:
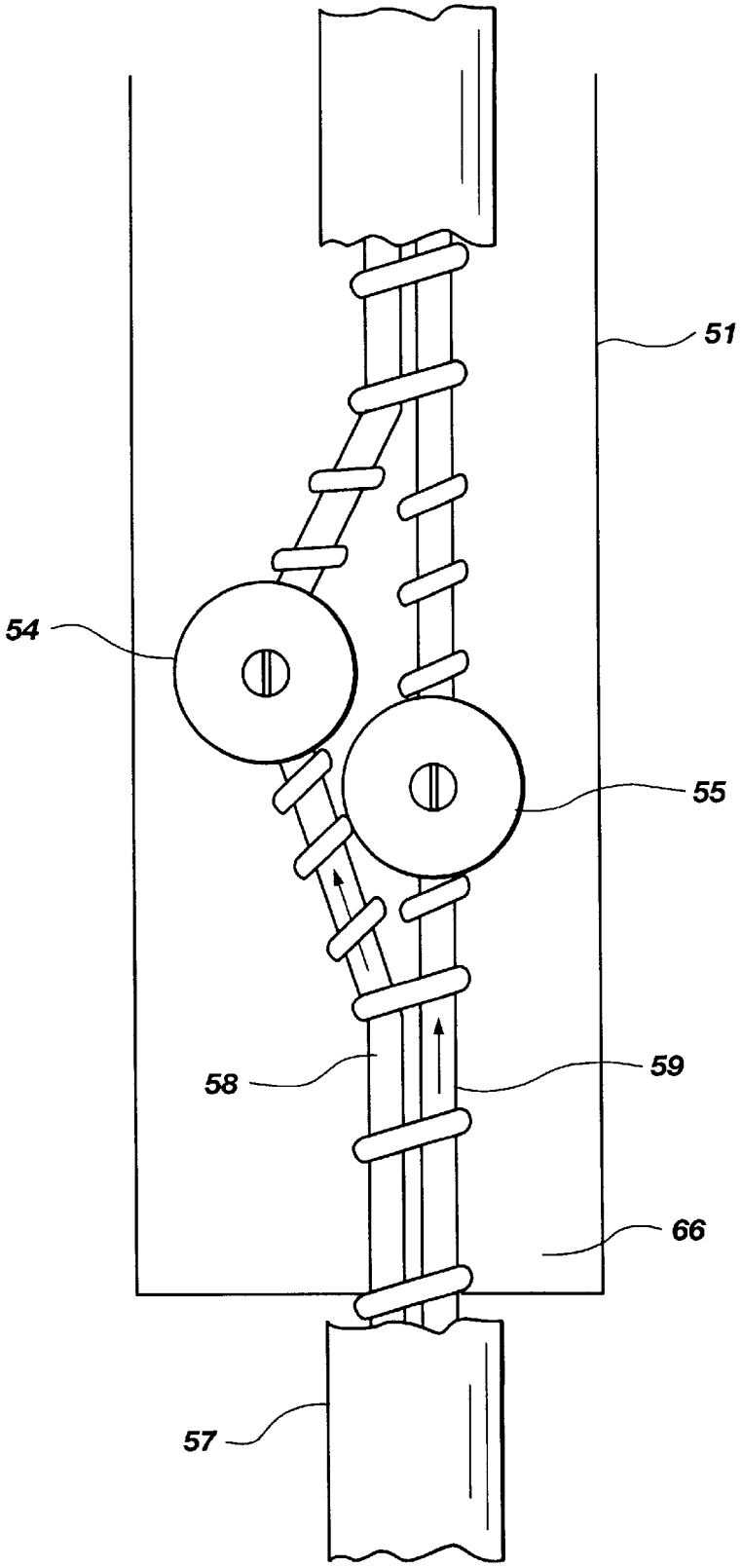
FIG. 6, a rear view of a countertop unit showing how base and mixing fluid enter and connect with solenoids before continuing to the dispenser head.

FIG. 6 is a lower rear view of a countertop dispensing unit 51, which shows the lines for the mixing fluid 58 and the base fluid 59 coming into the bottom of the dispensing unit 51 and running to the solenoid valves 54, 55. The lines are covered with insulation 57 and wrapped by the cooling fluid line 66.

Figure 7:
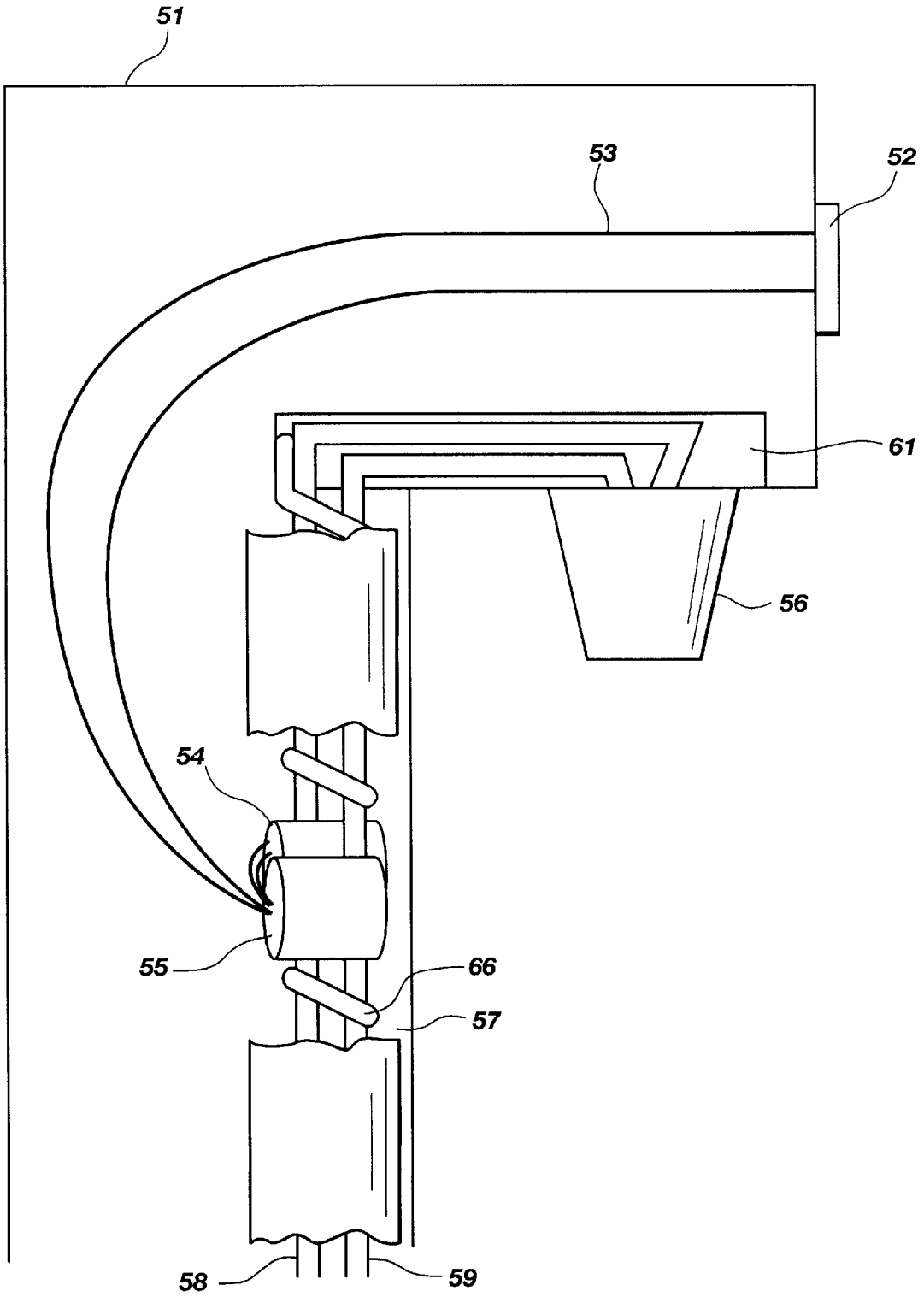
FIG. 7, a side elevational view of a countertop dispenser showing a preferred means of cooling using a lead heat exchange plate to provide a more constant temperature of both the mixing fluid and the base fluid.

FIG. 7 shows a side elevational view of the countertop dispensing unit 51 with a preferred system of cooling. After the base fluid line 59 and the mixing fluid line 58 leave the solenoid valves 54 and 55, they enter into a lead heat exchange plate 61 that takes the product to the dispensing head. This helps keep the product at a more constant and cooler temperature while not being dispensed.

A preferred system also employs the mixing fluid as the cooling fluid. When the dispensing activation switch 52 is activated, the base fluid solenoid 55 opens to allow the base product to flow. The mixing fluid solenoid valve 54 also opens and the cooling fluid line 66 (in this case, water) is diverted to the dispensing head 60 and is dispensed with the base fluid and mixed in the mixing cone 56.

Figure 8:
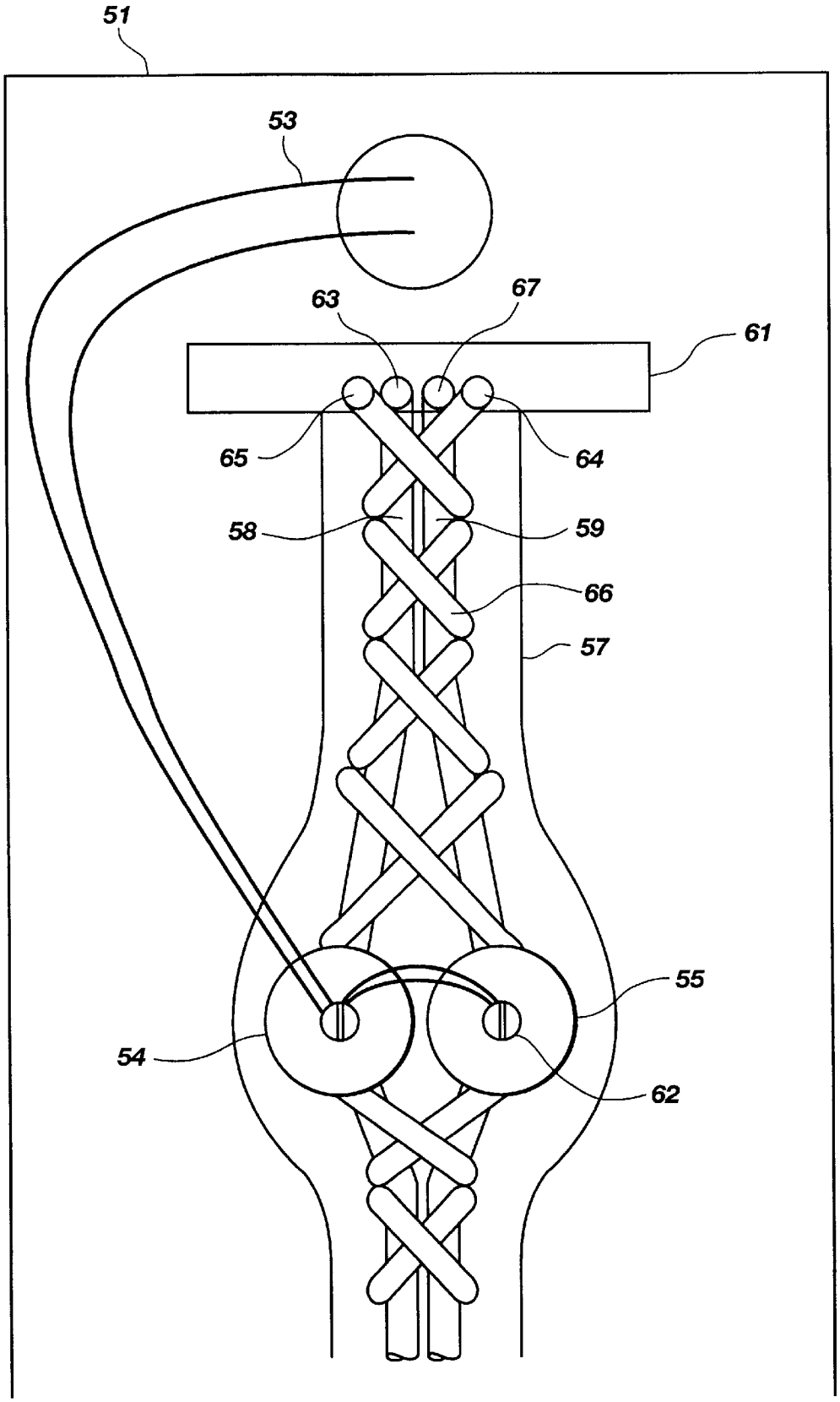
FIG. 8, a rear view of countertop unit showing a lead heat exchange plate in the top with the fluid lines running through the plate, including the solenoid with the adjustment screw and showing the base and mixing fluid lines.

FIG. 8 shows a rear view of the countertop dispensing unit 51. The base fluid line 59, the mixing fluid line 58, and the cooling fluid line 66 enter into the lead heat exchange plate 61.

The electrical wires 53 connect the dispensing activation switch 52 to the solenoid valves 54 and 55. The solenoid adjusting screws 62 for the solenoid valves 54, 55 set the mix ratio of the base fluid 59 and the mixing fluid 58. The cooling fluid inlet 64 provides for movement of the coolant product into the heat exchange plate 61. The cooling fluid outlet 65 channels the coolant product out of the heat exchange plate 61 back to the chilling/refrigerant unit. The inlet 63 for the base fluid line 59 allows the base fluid to enter into the heat exchange plate 61 or a cooling plate. The inlet 67 for the mixing fluid line 58 allows the mixing fluid to enter into the heat exchange plate 61 or a cooling plate.

While this invention has been described and illustrated herein with respect to preferred embodiments, it is understood that alternative embodiments and substantial equivalents are included within the scope of the invention as defined by the appended claims.

I claim:

1. A system for cooling the head of a beverage dispensing apparatus comprising in combination:

A beverage dispensing body having means for dispensing a beverage from a storage tank;

a dispensing head attached to the dispensing body, said dispensing head having at least one orifice through which the beverage to be dispensed is discharged;

a system of channels extending through said dispensing body and dispensing head to the point of discharge in the dispensing head for conducting coolant fluids for cooling the beverage entirely to the point of discharge from the dispensing head; and means for carrying coolant fluid from a cooling apparatus to the system of channels.

2. A system as set forth in claim 1, wherein the cooling apparatus is located apart from the dispensing apparatus.

3. A system as set forth in claim 1, having means for intermixing the cooling fluid with the beverage to be dispensed.

4. A system as set forth in claim 1, having means for returning the coolant from the dispensing apparatus to the cooling apparatus to be recooled.

5. A system as set forth in claim 4, wherein tubes for carrying the coolant fluid to the dispensing apparatus from the cooling apparatus are located adjacent to a beverage tube carrying the beverage to be dispensed, so that the beverage is cooled from the storage tank to the point of discharge from the dispensing head.

* * * * *